US005432995A

United States Patent [19]

Takenami et al.

[11] Patent Number: 5,432,995

[45] Date of Patent: Jul. 18, 1995

[54] TERMINAL CRIMPING APPARATUS

[75] Inventors: Yoshio Takenami; Eiji Fudoo; Masayuki Kawamura, all of Yokkaichi, Japan

[73] Assignee: Sumitomo Wiring Systems, Ltd., Japan

[21] Appl. No.: 207,656

[22] Filed: Mar. 9, 1994

[30] Foreign Application Priority Data

Mar. 9, 1993 [JP] Japan ..... 5-047791

[51] Int. Cl.[6] ..... H01R 43/055

[52] U.S. Cl. ..... 29/753; 29/33 M; 29/785; 29/863

[58] Field of Search ..... 29/33 M, 747, 748, 753, 29/785, 792, 861, 863, 882; 72/410, 412

[56] References Cited

U.S. PATENT DOCUMENTS

| | | | |
|---|---|---|---|
| 4,367,575 | 1/1983 | Forster et al. | 29/785 X |
| 4,653,182 | 3/1987 | Fukuda et al. | 29/861 X |
| 4,680,841 | 7/1987 | Schneider et al. | 29/33 M |
| 5,099,570 | 3/1992 | Gerhard, Jr. | 29/753 X |

FOREIGN PATENT DOCUMENTS

| | | | |
|---|---|---|---|
| 112736 | 8/1980 | Japan | 29/785 |
| 398278 | 4/1991 | Japan | 29/753 |
| 1202778 | 1/1986 | U.S.S.R. | 29/792 |

*Primary Examiner*—Peter Dungba Vo
*Attorney, Agent, or Firm*—Beveridge, DeGrandi, Weilacher & Young

[57] ABSTRACT

There is provided a terminal crimping apparatus for moving a plurality of crimp terminals respectively contained in a plurality of connector housings to a crimping position in a desired order to caulk the crimp terminal on an end of an electric wire. The terminal crimping apparatus includes one turntable for holding a plurality of types of pressure receiving members for receiving the crimp terminals and another turntable for holding a plurality of types of caulking members for caulking the crimp terminals between the turntable and the various types of pressure receiving members. A desired pressure receiving member alternatively selected by the rotation of one turntable is moved to a pressure receiving position. A desired caulking member alternatively selected by the rotation of the other turntable is moved to a caulking waiting position opposed to the crimp terminal in the crimping position. The caulking member in the caulking waiting position is pressed to the caulking position by a pressing mechanism, so that the crimp terminal is caulked on the end of the electric wire.

23 Claims, 8 Drawing Sheets

TERMINAL CRIMPING APPARATUS

CROSS REFERENCE TO RELATED APPLICATION

This application claims priority benefits under 35 USC § 119 of Japanese Patent Application Serial No. 5-47791, the disclosure of which is incorporated by reference.

BACKGROUND OF THE INVENTION

1. Field of the Invention

The present invention relates to a terminal crimping apparatus for caulking, inside of the connector housing a crimp terminal loaded in the connector housing to crimp an end of an electric wire on the crimp terminal onto an end of an electric wire.

2. Description of the Related Art

Crimping connectors using terminal fittings of an electric wire crimping type have been used as wiring harnesses for appliances, automobiles and the like.

In manufacturing wiring harnesses for appliances, i) Electric wires having a single thickness are used.

ii) In many cases, wiring harnesses are wired by so-called parallel wiring (corresponding ones of a plurality of terminals in a pair of connector housings are wired to have a one-to-one correspondence with each other).

iii) Moreover, wiring harnesses conforming to the same specification are manufactured in large quantities.

With respect to such wiring harnesses for appliances which use electric wires having a single thickness, are wired by parallel wiring and are mass-produced (for example, flat cables), there has been provided a terminal crimping apparatus of a simultaneous crimping type using comb-shaped crimpers and anvils and simultaneously caulking electric wires to respective crimp terminals loaded into connector housings (see Japanese Patent Laid-Open Gazette No. 98278/1991). The manufacture of the wiring harnesses for appliances can be automated relatively easily using the above described terminal crimping apparatus of a simultaneous crimping type.

On the other hand, in wiring harnesses for automobiles and the like, i) Electric wires having a plurality of different thicknesses are used.

ii) Furthermore, wiring harnesses are not wired by so-called parallel wiring. Specifically, ends of two electric wires are crimped on some crimp terminals. Alternatively, terminals in a plurality of connector housings are connected to one terminal in one connector housing. The assembled state of wiring harnesses wired by nonparallel wiring is illustrated in a simplified manner in FIG. 8. In FIG. 8, reference numeral 100 denotes a connector housing, reference numeral 101 denotes a thin electric wire, and reference numeral 102 denotes a thick electric wire. In addition, reference numeral 103 indicates a portion where two electric wires are crimped on the same crimp terminal.

iii) Additionally, in recent automobiles, a great deal of options are set for electronic components in addition to the fact that a great deal of grades are set in one type of automobile. Therefore, as wiring harnesses which are adapted to the automobiles, wiring harnesses conforming to a great deal of specifications must be manufactured. Moreover, the number of wiring harnesses conforming to each of the specifications to be manufactured is not too large. That is, few-of-a-kind wiring harnesses are forced to be produced.

With respect to such wiring harnesses for automobiles and the like which use electric wires having a plurality of thicknesses, which are wired by nonparallel wiring and which are the produced on a few-of-a-kind basis, there are following problems, so that a terminal crimping apparatus of a simultaneous crimping type cannot be applied to the manufacture thereof. Specifically, i) When one connector housing has n terminals, there are $3^n$ combinations as combinations in crimping respective ends of three types of electric wires, that is, one thin electric wire, two thin electric wires and a thick electric wire on the respective terminals. Three types of crimp terminals are used to correspond to the three types of electric wires. When the crimping is completed, the heights of the three types of crimp terminals differ from each other. When the three types of electric wires are crimped using a crimping apparatus, a stroke for pressing a crimper serving as a pressing member against the crimp terminal received by an anvil serving as a pressure receiving member differs depending on the type of crimp terminal.

In the above described type of simultaneously crimping a plurality of terminals in one connector housing, therefore, a lot of, that is, the above described $3^n$ (81 n=4) comb-shaped crimpers and anvils which are adapted thereto must be produced to stand by as required. Work (rearrangement) selecting required crimpers and anvils conforming to the specification of the connector housing out of the above described crimpers and anvils to replace them is required. Therefore, it has been difficult to apply the simultaneous crimping type to the automation of the manufacture of wiring harnesses because it is too complicated. Moreover, few-of-a-kind wiring harnesses are produced, so that the rearrangement must be frequently made. Consequently, the simultaneous crimping type which requires complicated rearrangement is more unsuitable for the automation.

ii) Furthermore, in the simultaneous crimping type, the order of crimping is specified for each connector housing, so that the following situations arise. Specifically, when a crimp terminal in one connector housing is crimped, a plurality of electric wires which should be crimped on the above described crimp terminal in the one connector housing may, in some cases, include an electric wire having its end already crimped on a crimp terminal in another connector housing. In this case, the other end of the electric wire whose one end is crimped on the crimp terminal in the above described one connector housing cannot be crimped until the crimping process of the one connector housing. As a result, a lot of electric wires must wait in a state where one end of each of the electric wires is hung on the crimp terminal in the above descried other connector housing until the crimping process of the other connector housing. Moreover, the destinations of the other ends of the electric wires must be respectively judged. Consequently, it is extremely difficult to apply the simultaneous crimping type to the automation of the manufacture of wiring harnesses because the crimping process becomes enormously complicated.

SUMMARY OF THE INVENTION

An object of the present invention is to provide a terminal crimping, apparatus capable of efficiently crimping in a connector housing, electric wires which differ in thickness and capable of easily automating the manufacture of wiring harnesses for automobiles and the like.

In order to attain the above described object, one mode of the present invention is characterized by comprising holding means for holding a plurality of connector housings in which a plurality of types of crimp terminals are loaded, first conveying means for moving the holding means to alternatively convey the desired crimp terminal in the desired connector housing to a crimping position for crimping the crimp terminal on an end of an electric wire, a plurality of pressure receiving means respectively provided to correspond to the types of crimp terminals for receiving in a pressure receiving position the crimp terminal in the crimping position, a plurality of caulking means respectively provided to correspond to the types of crimp terminals and each moved to a caulking position to caulk the crimp terminal in the crimping position between the caulking means and the pressure receiving means in the pressure receiving position, second conveying means for conveying the desired pressure receiving means alternatively selected out of the plurality of pressure receiving means to the pressure receiving position, position holding means for holding in the pressure receiving position the pressure receiving means conveyed to the pressure receiving position, third conveying means for conveying the desired caulking means alternatively selected out of the plurality of caulking means to a caulking waiting position opposed to the crimp terminal in the crimping position, and pressing means for pressing the caulking means in the caulking waiting position to the caulking position so as to caulk the crimp terminal between the pressing means and the pressure receiving means in the pressure receiving position.

In accordance with the above described mode, the desired crimp terminal in the desired connector housing held by the holding means is conveyed to the crimping position by the first conveying means. The pressure receiving means which is adapted to the desired crimp terminal is conveyed to the pressure receiving position by the second conveying means and then, is held in the pressure receiving position by the position holding means. In addition, the caulking means which is adapted to the desired crimp terminal is conveyed to the caulking waiting position by the third conveying means. The caulking means in the caulking waiting position is then pressed to the caulking position by the pressing means, so that the crimp terminal is caulked between the pressure receiving means and the caulking means. The foregoing operations are sequentially repeated, thereby to complete the crimping of all the crimp terminals loaded into the plurality of connector housings.

The respective crimp terminals in the plurality of connector housings can be crimped in a desired order of crimping while selecting the caulking means and the pressure receiving means which are adapted to each of the crimp terminals. Consequently, the terminal crimping apparatus according to the present invention can freely cope with wiring performed in various manners between the plurality of connector housings using electric wires having various thicknesses, and can be easily applied to the automation of the manufacture of wiring harnesses for automobiles and the like. In addition, the number of caulking means and pressure receiving means to be prepared may be relatively small to correspond to the number of types of crimp terminals. Consequently, it is very easy to make rearrangement, thereby to make it possible to crimp each of the crimp terminals efficiently. Therefore, the terminal crimping apparatus is also suitable for the manufacture of wiring harnesses for automobiles and the like whose number to be manufactured for one lot is small.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The present invention will be described in detail with reference to the appended drawings showing embodiments.

Figure 3:
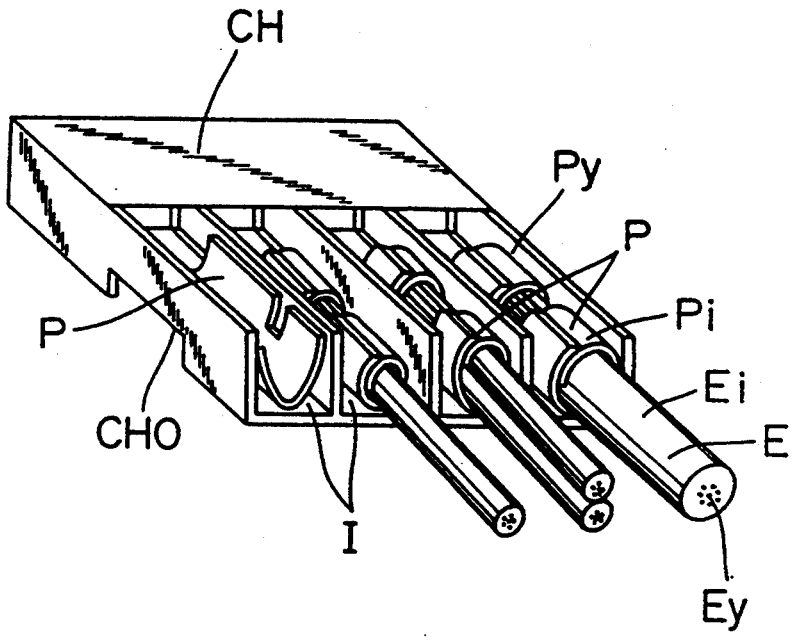
FIG. 3 is a perspective view showing a connector housing.

Referring to FIG. 3, a plurality of crimp terminal inserting portions I are provided side by side in a connector housing CH, and a crimp terminal P is inserted into each of the crimp terminal inserting portions I. The crimp terminal P has a wire barrel portion Py for holding a conductor Ey in an end of an electric wire E and an insulation barrel portion Pi for holding an insulated portion Ei in the end of the electric wire E. The connector housing CH has an opening CHO on its rear surface. The opening CHO is formed in a portion, which is opposed to the rear surface of the wire barrel portion Py, of the crimp terminal P inserted into the crimp terminal inserting portion I, into which an anvil for a conductor Ay of an anvil A as described later is to be introduced.

Figure 1:
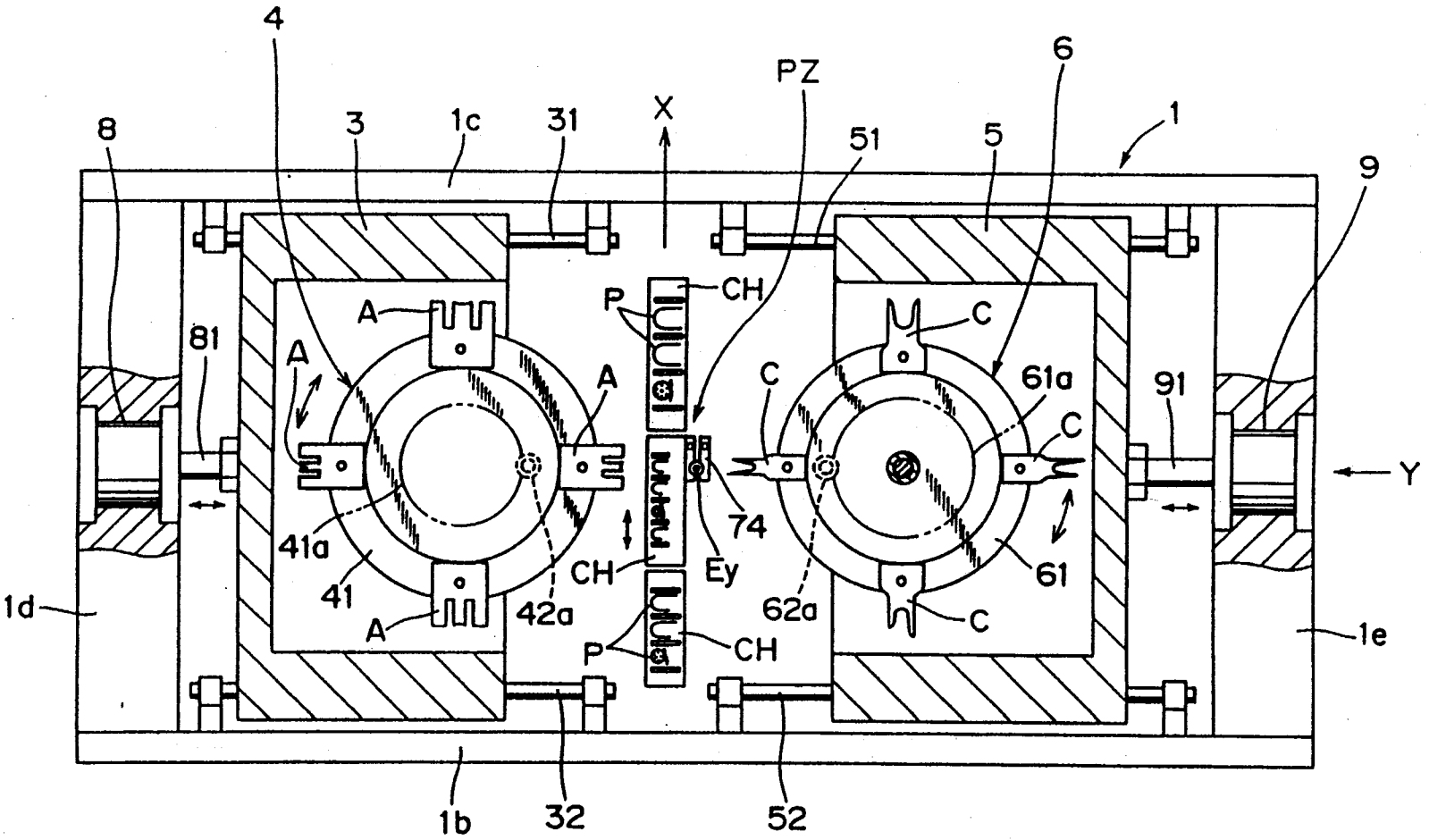
FIG. 1 is a plan view partly in section showing a terminal crimping apparatus according to one embodiment of the present invention.
Figure 2:
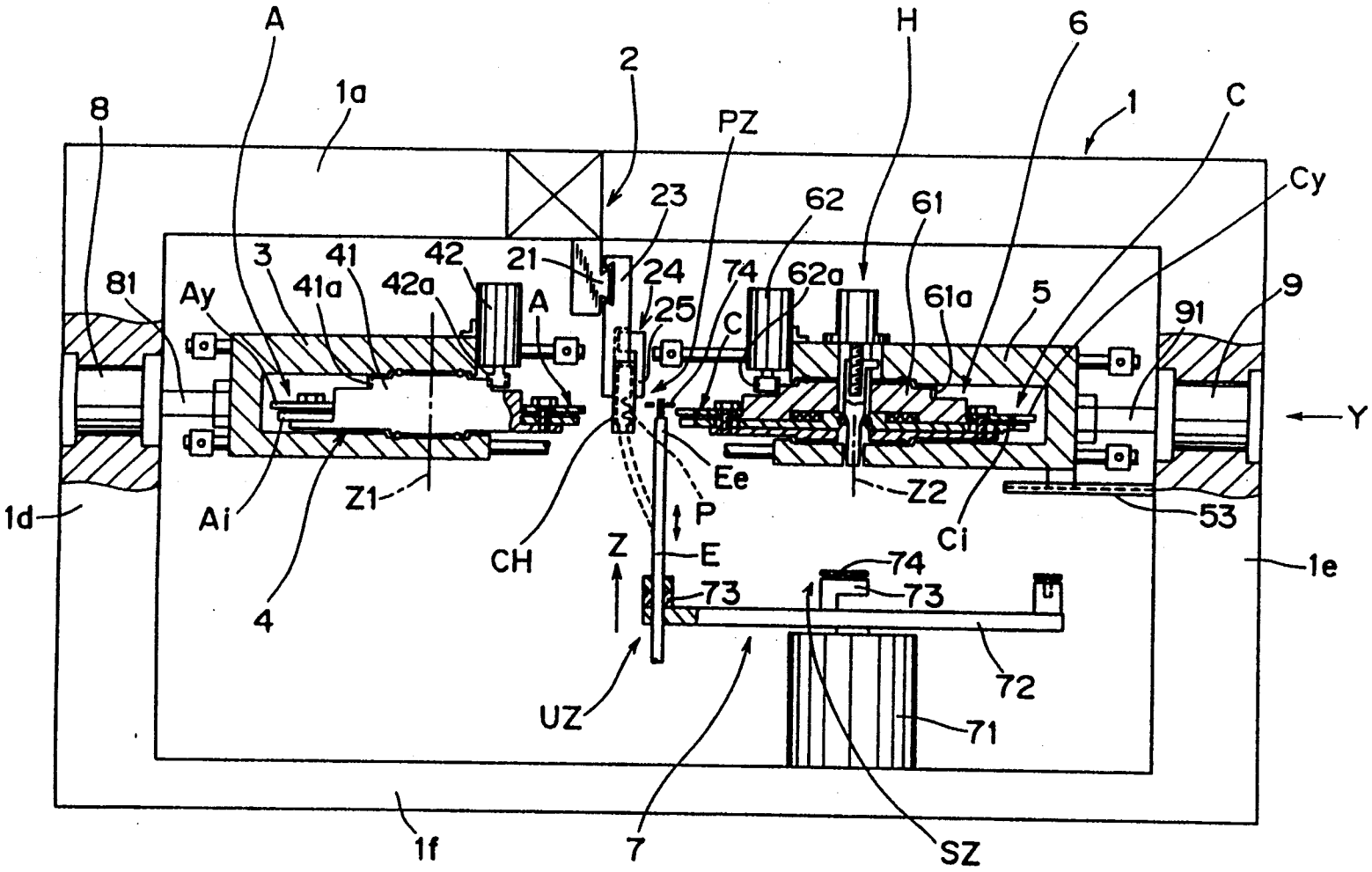
FIG. 2 is a side elevation partly in section showing the terminal crimping apparatus.

Referring to FIG. 1, the terminal crimping apparatus is a terminal crimping apparatus of a so-called in-housing crimping type for caulking the crimp terminal P in a state where the crimp terminal P is loaded into each of the crimp terminal inserting portions I in the connector housing CH to crimp the crimp terminal P on the end of the electric wire E. Referring to FIGS. 1 and 2, the main feature of the terminal crimping apparatus is that the crimp terminals P are sequentially crimped while moving a desired crimp terminal P in a desired connector housing CH to a crimping position PZ and selecting a crimper C serving as caulking means and an anvil A serving as pressure receiving means 20 which are adapted to the crimp terminal P.

Referring to FIGS. 1 and 2, the terminal crimping apparatus comprises:

i) a frame-shaped apparatus body 1, ii) an X-axis conveying mechanism 2 for holding a plurality of connector housings CH and moving the desired crimp terminal P in the desired connector housing CH to the crimping position PZ in the direction of the X axis, iii) an anvil conveying mechanism 4 for holding a plurality of types of anvils A and moving the desired anvil A to a pressure receiving position opposed to the crimp terminal P in the crimping position PZ, iv) a crimper conveying mechanism 6 for holding a plurality of types of crimpers C and moving the desired crimper C to a caulking waiting position opposed to the crimp terminal P in the crimping position PZ, v) an electric wire feeding mechanism 7 for sequentially feeding ends of electric wires E stripped to a predetermined position between the crimp terminal P in the crimping position PZ and the crimper C in the caulking waiting position, and vi) a hydraulic cylinder for a crimper 9 serving as pressing means for pressing the crimper C in the caulking waiting position to a caulking position on the side of the connector housing CH by predetermined pressure.

The apparatus body 1 has an upper frame portion 1*a*, a front frame portion 1*b*, a rear frame portion 1*c*, a left frame portion 1*d*, a right frame portion 1*e* and a lower frame portion 1*f* formed into a predetermined frame structure.

Referring to FIG. 2, the anvil A is constituted by an anvil for a conductor Ay in the upper stage and an anvil for an insulated portion Ai in the lower stage fixed integrally with the anvil Ay. In addition, the crimper C is constituted by a crimper for a conductor Cy in the upper stage and a crimper for an insulated portion Ci in the lower stage.

Figure 4:
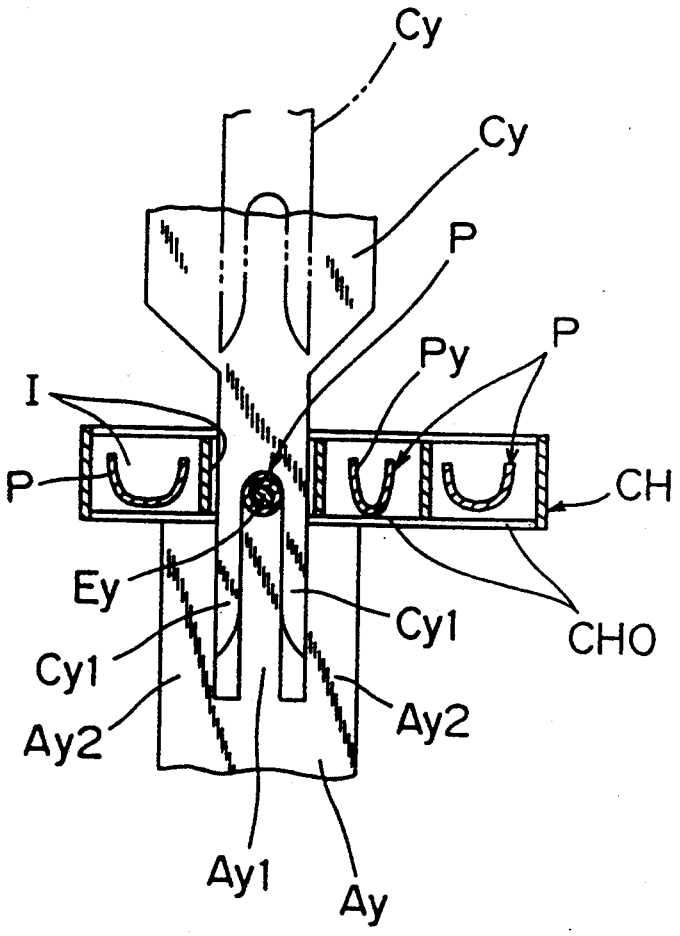
FIG. 4 is a plan view showing a connector housing in a state at the time of crimping.

Referring to FIG. 4 showing the crimped state of the crimp terminal P, the crimper for a conductor Cy and the anvil for a conductor Ay caulk and crimp the wire barrel portion Py of the crimp terminal P with the wire barrel portion Py interposed therebetween. The crimper for a conductor Cy is in a forked shape in which an anvil body Ay1 of the anvil for a conductor Ay can be introduced into an area between a pair of prongs Cy1 with no clearance. The entire anvil for a conductor Ay assumes an E shape by integrally forming a pair of prong clamping portions Ay2 on both sides of the anvil body Ay1. The prong clamping portions Ay2 clamp the prongs Cy1 of the crimper for a conductor Cy between the prong clamping portions Ay2 and the anvil body Ay1 to prevent the prongs Cy1 from being apart. At the time of caulking, the anvil for a conductor Ay enters the connector housing CH from the opening CHO of the connector housing CH and abuts against the rear surface of the crimp terminal P, to receive a caulking load imposed by the crimper for a conductor Cy.

Figure 6:
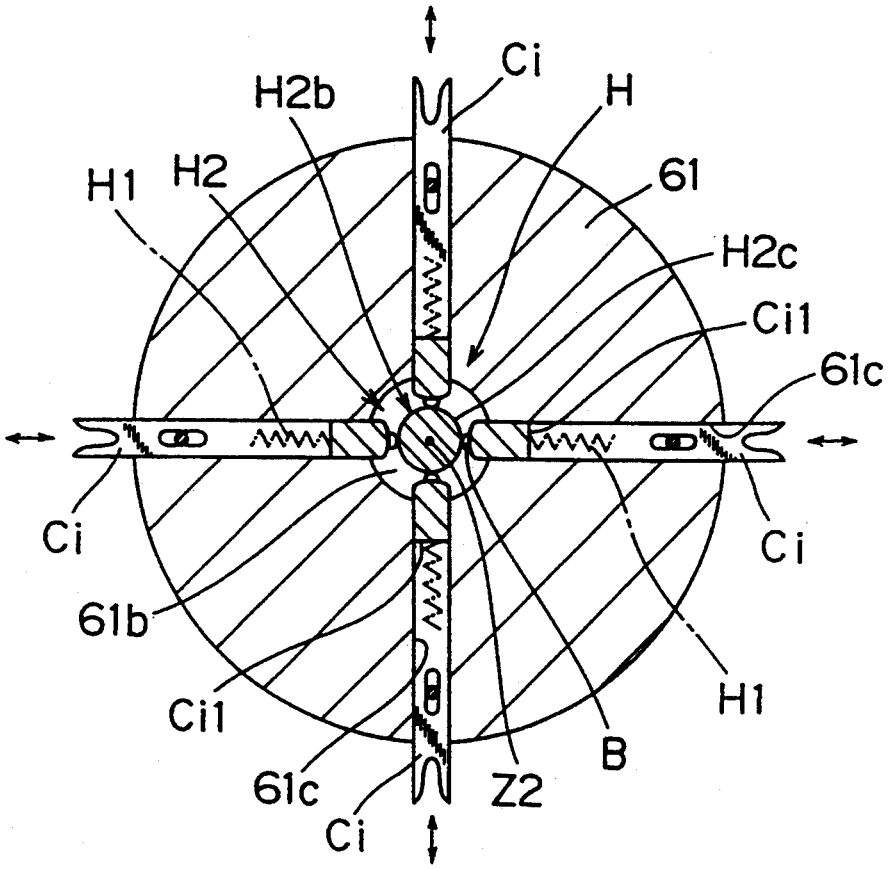
FIG. 6 is a cross sectional view taken along a line VI—VI shown in FIG. 5.

The crimper for an insulated portion Ci is formed in a forked shape which is approximately the same as the crimper for a conductor Cy, as shown in FIG. 6, which caulks and crimps the insulation barrel portion Pi in the crimp terminal P with the insulation barrel portion Pi interposed between the crimper Ci and the connector housing CH. The anvil for an insulated portion Ai is rectangular in shape, and abuts against the rear surface of the connector housing CH at the time of caulking, to receive a caulking load imposed by the crimper for an insulated portion Ci through the connector housing CH.

Referring to FIGS. 1 and 2, the above described X-axis conveying mechanism 2 comprises i) a support rail 21 fixed to the upper frame portion 1*a*, of the apparatus body 1 and extending in the direction of the X axis, ii) a slider 23 supported slidably in the direction of the X axis by the support rail 21, iii) a connector housing holding portion 24 provided in a lower end of the slider 23 for clamping and detachably holding the plurality of connector housings CH, and iv) a driving mechanism (not shown) for moving the slider 23 to a predetermined position in response to a signal from a control portion (not shown). As the driving mechanism, a known feed screw mechanism using a pulse motor, a ball screw and the like can be illustrated as the driving mechanism.

The above described connector housing holding portion 24 has a clamping member 25 for clamping the connector housing CH between the clamping member 25 and the lower end of the slider 23. The connector housing holding portion 24 holds the plurality of connector housings CH with they being arranged in the direction in which the crimp terminals P in the connector housing CH are arranged.

The anvil conveying mechanism 4 comprises i) a slider for an anvil 3 supported slidably in the direction of the Y axis by the front and rear frame portions 1*b* and 1*c* of the apparatus body 1, ii) a turntable for an anvil 41 rotatably supported by the slider for an anvil 3 for holding the plurality of anvils A, iii) a pulse motor for an anvil 42 fixed to the slider for an anvil 3 for driving the turntable for an anvil 41 to rotate, and iv) a hydraulic cylinder for an anvil 8 fixed to the left frame,portion 1*d* of the apparatus body 1 for moving the slider for an anvil 3 in the direction of the Y axis to move the predetermined anvil A to the pressure receiving position and hold the position thereof.

Rods 31 and 32 respectively fixed to the front frame portion 1*b* and the rear frame portion 1*c* and parallel to each other in the direction of the Y axis are inserted through the above described slider for an anvil 3. In this state, the slider for an anvil 3 is supported slidably in the direction of the Y axis by the rods 31 and 32.

The plurality of types of anvils A are mounted spaced apart from each other by a predetermined distance along the outer periphery of the turntable for an anvil 41.

A gear portion 42*a* fixed to a main shaft of the pulse motor for an anvil 42 is engaged with a gear portion 41*a* formed in the turntable for an anvil 41, so that the turntable for an anvil 41 is driven through the gear portions 41*a* and 42*a* by the pulse motor for an anvil 42.

Referring to FIGS. 1 and 2, the above described hydraulic cylinder for an anvil 8 expands and contracts a rod 81 to move the slider for an anvil 3. Consequently, the anvil for a conductor Ay is moved to the wire barrel portion Py of the crimp terminal P, and the anvil for an insulated portion Ai is moved to a position where it abuts against the rear surface of the connector housing CH, that is, the pressure receiving position. The respective anvils Ay and Ai are held in the pressure receiving position.

The above describe crimper conveying mechanism 6 comprises i) a slider for a crimper 5 supported slidably in the direction of the Y axis by the front and rear frame portions 1*b* and 1*c* of the apparatus body 1, ii) a turntable for a crimper 61 rotatably supported by the slider for a crimper 5 for holding a plurality of crimpers C, and iii) a pulse motor 62 for a crimper fixed to the slider for a crimper 5 for driving the turntable for a crimper 61 to rotate.

Rods 51 and 52 respectively fixed to the front frame portion 1*b* and the rear frame portion 1*c* and parallel to each other in the direction of the Y axis are inserted through the slider for a crimper 5. In this state, the slider for a crimper 5 is supported slidably in the direction of the Y axis by the rods 51 and 52. In addition, a linear sensor 53 (see FIG. 2) for detecting a stroke position in the direction of the Y axis of the slide base for a crimper 5 is mounted on the right frame portion 1*e* of the apparatus body 1.

The plurality of types of crimpers C are mounted spaced apart from each other by a predetermined distance along the outer periphery of the turntable for a crimper 61.

A gear portion 62*a* fixed to a main shaft of the pulse motor for a crimper 62 is engaged with a gear portion 61*a* formed in the turntable for a crimper 61, so that the turntable for a crimper 61 is driven through the gear portions 62*a* and 61*a* by the pulse motor for a crimper 62.

Figure 5:
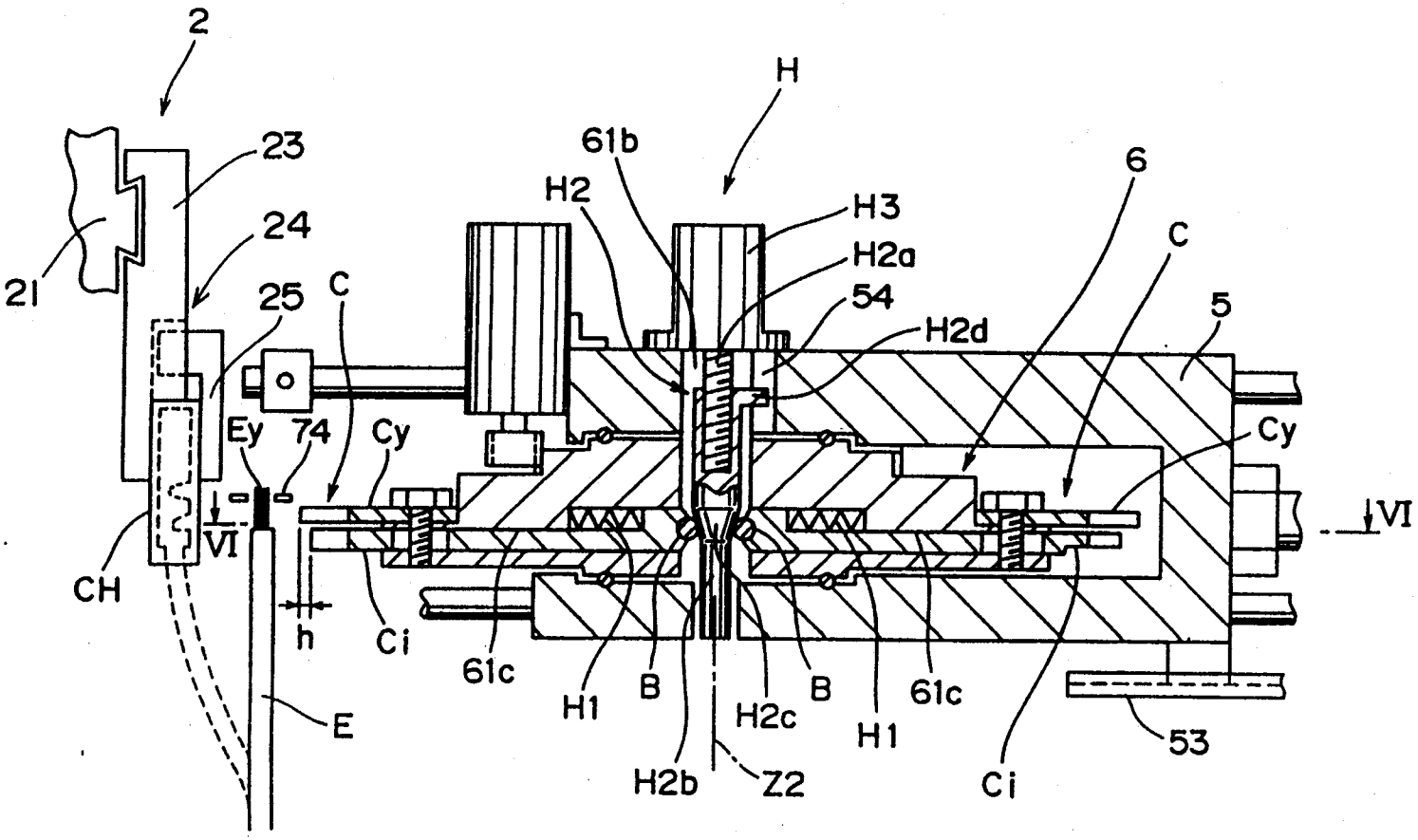
FIG. 5 is an enlarged view showing a principal part of a height adjusting mechanism.

Referring to FIG. 5, the crimper for a conductor Cy in the upper stage is immovably mounted on the turntable for a crimper 61 by a bolt 63. The crimper for an insulated portion Ci in the lower stage is mounted movably in the radial direction of the turntable for a crimper 61. The crimper for an insulated portion Ci can adjust the relative position of the crimper for an insulated portion Ci to the crimper for a conductor Cy in the radial direction of the turntable for a crimper 61 by a relative position adjusting mechanism H as described later.

Referring to FIGS. 5 and 6, a through hole 61*b* extending in the longitudinal direction is formed in the center of the turntable for a crimper 61. In addition, a plurality of insertion holes of a crimper for an insulated portion 61*c* extending in the radial direction from an outer edge of the turntable for a crimper 61 to the through hole 61*b* are formed by dividing the circumference into equal divisions, and the crimper for an insulated portion Ci is slidably inserted into each of the insertion holes of a crimper for an insulated portion 61*c*. One end of each of the insertion holes of a crimper for an insulated portion Ci is projected into the through hole 61*b*, and a rotatable ball B is held in the one end in a state where its part is exposed.

The relative position adjusting mechanism H comprises i) a helical compression spring H1 interposed between a step Ci1 of the above described crimper for an insulated portion Ci and a step of an upper inner surface of the insertion hole of a crimper for an insulated portion 61*c* for urging the crimper for an insulated portion Ci inward in the radial direction of the turntable for a crimper 61, and ii) a moving-mechanism H2 disposed in the through hole 61*b* for pressing the crimper for an insulated portion Ci outward in the radial direction against the helical compression spring H1 to move the same.

The above described moving mechanism H2 comprises i) a pulse motor H3 serving as driving means fixed to an upper surface portion of the slider for a crimper 5, ii) a feed screw H2*a* rotated and driven by the pulse motor H3, and iii) a nut member H2*b* engaged with the feed screw H2*a*. A conical tapered surface H2*c* for positioning the crimper for an insulated portion Ci in a state where it abuts against a ball B of the crimper for an insulated portion Ci is formed in the intermediate portion on the outer periphery of the nut member H2*b*. In addition, a projection H2*d* inserted into a longitudinal groove 54 of the slider for a crimper 5 is integrally formed in the upper end of the nut member H2*b*. The nut member H2*b* is movable up and down in a state where the rotation thereof is regulated. In the relative position adjusting mechanism H, the feed screw H2*a* is rotated to move the nut member H2*b* up and down so that the crimper for an insulated portion Ci is put in a predetermined position in the radial direction of the turntable for a crimper 61 through the conical tapered surface H2*c* of the nut member H2*b*. As a result, a relative height h of the crimper for an insulated portion Ci to the crimper for a conductor Cy (see FIG. 6) is adjusted in, for example, approximately six stages. The setting of the relative height h allows the difference in a stroke for pressing between the crimper for an insulated portion Ci and the crimper for a conductor Cy at the time of caulking (the positional relationship at the time of maximum pressing) to be adjusted.

Figure 7:
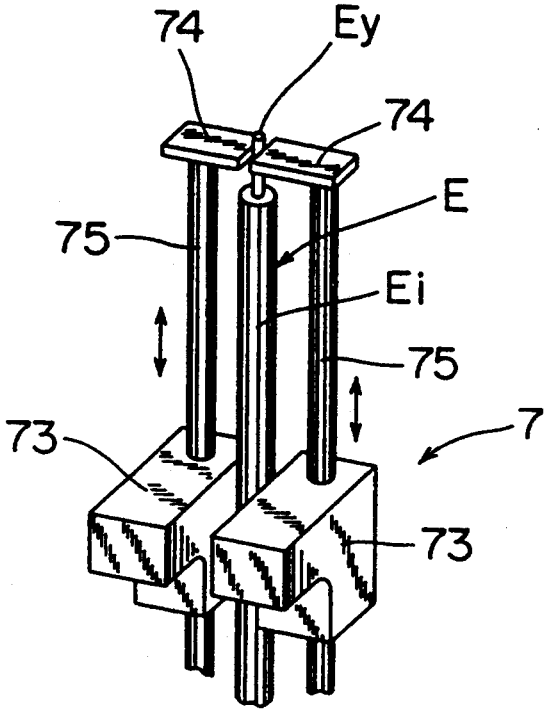
FIG. 7 is a perspective view showing a clamp of an electric wire feeding mechanism.
Figure 8:
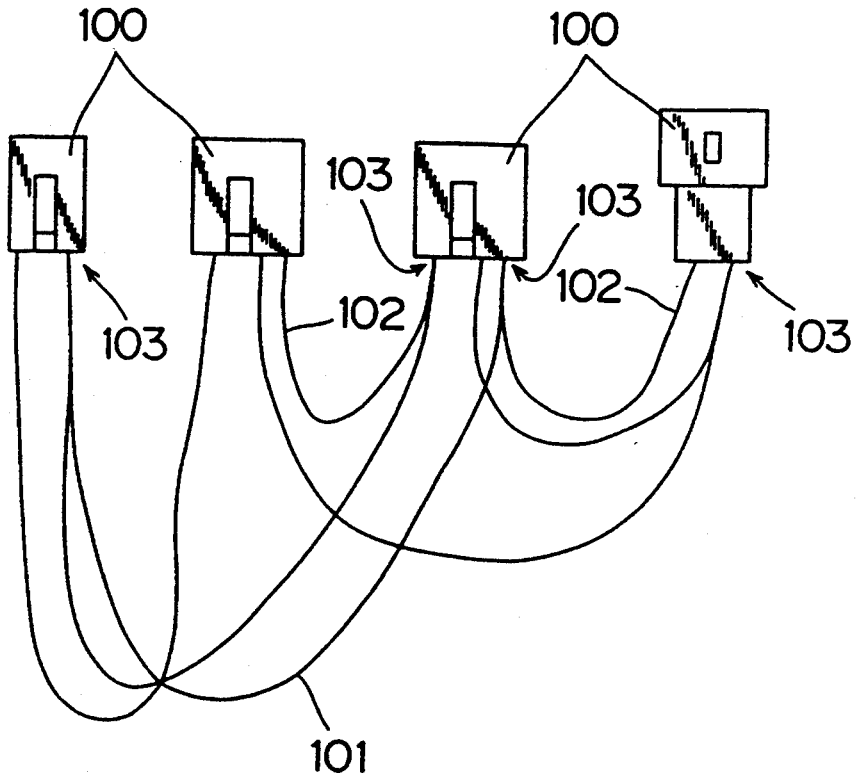
FIG. 8 is an illustration showing an assembled state of wiring harnesses in a simplified manner.

Referring to FIGS. 2 and 7, the above described electric wire feeding mechanism 7 comprises i) a pulse motor 71 fixed to the lower frame portion 1*f* of the apparatus body 1, ii) a turntable 72 driven to rotate by the pulse motor 71, iii) a plurality of pairs of clamps for an insulated portion 73 disposed by dividing the circumference into equal divisions on an upper surface portion of an outer edge of the turntable 72, and iv) a pair of clamps for a conductor 74 disposed above the pair of clamps for an insulated portion 73 and mounted on the upper ends of expansion shafts 75 passing through the respective clamps for an insulated portion 73. The distance between the clamps for an insulated portion 73, 73 can be adjusted by a feed screw (not shown in the drawing), passing through the clamps 73, 73 so that the clamps 73, 73 can clamp an insulated portion of the end of the electric wire E. At the time of adjusting the distance between the clamps 73, 73 by the feed screw the distance between the clamps for a conductor 74, 74 can be adjusted.

In this electric wire feeding mechanism 7, the clamp for a conductor 74 on which an end of an electric wire to be crimped is clamped is moved to a lower crimping position UZ below the crimping position PZ as the turntable 72 is rotated. The clamp for a conductor 74 which is moved to the lower crimping position UZ moves the end of the electric wire E to a predetermined position between the crimp terminal P in the crimping position PZ and the crimper C in the caulking waiting position as the expansion shaft 75 is expanded. A stop position of at least one of the clamps other than the lower crimping position UZ is set as an electric wire feeding position SZ to which the end of the stripped electric wire E which is to be clamped is fed.

The hydraulic cylinder for a crimper 9 serving as pressing means is fixed to the right frame portion le of the apparatus body 1 for moving the slider for a crimper 5 in the direction of the Y axis by expanding and contracting its rod 91. Consequently, the end of the electric wire E is pressed into the crimp terminal P by predetermined pressure by the crimper C, and the crimp terminal P is caulked with it being interposed between the crimper C and the anvil A as described above. The maximum pressing position of the crimper C at the time of caulking (the position directly related to a so-called crimp height which is the height of the crimp terminal after crimping) can be monitored by a linear sensor 53. A caulking operation is previously performed by way of trial to set the hydraulic pressure of the hydraulic cylinder for a crimper 9 so that a predetermined crimp height is attained and then, the formal caulking operation is performed. At the time of the caulking operation, the hydraulic cylinder for a crimper in which the hydraulic pressure or a value detected by the linear sensor 53 is outside of a predetermined range is judged to be faulty.

The operation of the above described terminal crimping apparatus will be described in the order of processes.

1) The electric wire E is stripped by the known method and then, the stripped electric wire E is fed into the clamps 73 and 74 which are stopped in the electric wire feeding position DZ by a robot or the like while intermittently rotating the turntable 72 of the electric wire feeding mechanism 7 through a predetermined angle to clamp the electric wire E. When two electric wires are together crimped on the crimp terminal P, the electric wire feeding operation is performed twice by the electric wire feeding mechanism 7 to clamp the two electric wires E by the same clamps 73 and 74.

2) The desired crimp terminal P in the desired connector housing CH is moved to the crimping position PZ by the X-axis conveying mechanism 2.

3) The turntables 41 and 61 of the conveying mechanism 4 and 6 are rotated simultaneously with the operation described in the item 2), and the anvil A and the crimper C which are adapted to the type of terminal P to be crimped are respectively moved to a position in close proximity to the pressure receiving position and the caulking waiting position. When the adapted crimp terminal P has been already put in the crimping position PZ, the anvil A and the crimper C are not moved.

4) The turntable 72 of the electric wire feeding mechanism 7 is rotated simultaneously with the operation described in the item 2) to move the end of the desired electric wire E to the lower crimping position UZ, and the clamp for a conductor 74 is raised to move the end of the electric wire E to a predetermined position between the crimp terminal P in the crimping position PZ and the crimper C in the caulking waiting position. Consequently, a state shown in FIGS. 1 and 2 occurs.

5) The hydraulic cylinder for an anvil 8 expands the rod 81 to move the anvil A toward the rear surface of the connector housing CH and put the same in the pressure receiving position.

6) The hydraulic cylinder for a crimper 9 expands the rod 91 a little later than the operation described in the item 5), to move the crimper C toward the connector housing CH. Consequently, the end of the electric wire E is pushed into the crimp terminal P by the crimper C, and caulks the crimp terminal P under a pressure with the crimp terminal P interposed between the crimper C and the anvil A.

7) When the crimping is completed, the hydraulic cylinders 8 and 9 respectively contract the rods 81 and 91, so that the crimper C and the anvil A retreat. Consequently, the crimping of one crimp terminal is completed.

8) The crimping process of the subsequent crimp terminal P is started and the above described processes described in the items 2) to 7) are repeated, to crimp the crimp terminals P in the plurality of connector housings CH in a desired order. Consequently, assembling of wiring harnesses in a complicated wired configuration is completed. When the processes described in the items 2) to 7) are repeated, the relative height h of the crimper for an insulated portion Ci to the crimper for a conductor Cy is adjusted by the relative position adjusting means H if required depending on the type of crimp terminal P.

According to the present embodiment, the crimp terminals P in the plurality of connector housings CH can be crimped in a desirable order of crimping while selecting the crimper C and the anvil A which are adapted to each of the crimp terminals. Consequently, the terminal crimping apparatus according to the present embodiment can freely cope with wiring performed in various manners between the plurality of connector housings CH using electric wires having various thicknesses and can be easily applied to automation of the manufacture of wiring harnesses for automobiles and the like. In addition, the number of crimpers C and anvils A to be prepared may be relatively small to correspond to the number of types of crimp terminals P. Consequently, it is very easy to make rearrangement, thereby to make it possible to crimp the crimp terminals P efficiently. Consequently, the terminal crimping apparatus is also suitable for the manufacture of wiring harnesses for automobiles and the like whose number to be manufactured for one lot is small.

Furthermore, it is possible to relatively adjust the heights in the direction of pressing of the crimper for a conductor Cy and the crimper for an insulated portion Ci of the crimper C by the relative position adjusting means H. Therefore, the terminal crimping apparatus according to the present embodiment can cope with electric wires having a larger number of thicknesses by a smaller number of crimpers C.

The present invention is not limited to the above described embodiments. For example, although in the above described embodiments, the conveying means 4 and 6 are of a rotating and moving type using the turntables 41 and 61, they may be of a linear moving type for sliding the crimper C and the anvil A in the direction of the X axis. Furthermore, a circular, pentagonal or hexagonal shape can be adopted as a plane shape of each of the turntables 41, 61 and 72.

In addition thereto, various design changes can be made within the range in which the gist of the present invention is not altered.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A terminal crimping apparatus comprising:

first conveying means, said first conveying means including a connector housing holding portion for holding a plurality of connector housings in each of which a plurality of types of crimp terminals are loadable, said first conveying means conveying a desired crimp terminal in one desired connector housing of said plurality to a crimping position where an end of an electric wire, onto which the desired terminal is to be crimped, is provided;

a plurality of pressure receiving means respectively provided to correspond to said plurality of types of crimp terminals, each of said pressure receiving means receiving, in a pressure receiving position, a crimp terminal placed in said crimping position;

a plurality of caulking means corresponding to said plurality of types of crimp terminals, one of said caulking means caulking a crimp terminal placed in said crimping position in cooperation with one of said pressure receiving means placed in said pressure receiving position;

second conveying means, said second conveying means including a pressure receiving means holding portion for holding said plurality of pressure receiving means, said second conveying means conveying one desired pressure receiving means of said plurality to said pressure receiving position;

position holding means for holding, in said pressure receiving position, said desired pressure receiving means conveyed to said pressure receiving position;

third conveying means, said third conveying means including a caulking means holding portion for holding said plurality of caulking means, said third conveying means conveying one desired caulking means of said plurality to a caulking waiting position opposed to said crimping position, said desired caulking means placed in said caulking waiting position being movable toward said crimping position; and pressing means for pressing said desired caulking means placed in said caulking waiting position toward said crimping position so as to caulk said desired crimp terminal between said desired caulking means and said desired pressure receiving means placed in said pressure receiving position.

2. The terminal crimping apparatus according to claim 1, wherein said connector housing holding portion holds said plurality of connector housings such that they are arranged in a direction along which the crimp terminals in each of the connector housings are arranged, and said first conveying means further includes a connector housing holding portion supporting member for slidably supporting said connector housing holding portion in said direction along which said the crimp terminals are arranged.

3. The terminal crimping apparatus according to claim 1, wherein said connector housing holding portion includes a pair of clamping members for clamping a predetermined portion of a connector housing.

4. The terminal crimping apparatus according to claim 1, wherein said pressure receiving means holding portion includes a rotating member rotatably supported around a predetermined axis by rotation-allowing supporting means, said plurality of pressure receiving means being mounted on said rotating member and arranged in a direction of rotation of said rotating member, and said second conveying means further includes rotational driving means for driving said rotating member to rotate around said axis.

5. The terminal crimping apparatus according to claim 4, wherein said second conveying means further includes a slide allowable supporting means for supporting said rotation-allowing supporting means slidably in a predetermined direction, and a moving mechanism for moving said rotation-allowing supporting means in said predetermined direction.

6. The terminal crimping apparatus according to claim 5, wherein said moving mechanism includes a fluid power mechanism.

7. The terminal crimping apparatus according to claim 6, wherein said hydraulic mechanism also serves for said position holding means.

8. The terminal crimping apparatus according to claim 1, wherein said caulking means holding portion includes a rotating member rotatably supported around a predetermined axis by rotation-allowing supporting means, said plurality of caulking means being mounted on said rotating member and arranged in a direction of rotation of said rotating member, and said third conveying means further includes rotational driving means for driving said rotating member to rotate around said axis.

9. The terminal crimping apparatus according to claim 8, further comprising slide allowable means for supporting said rotation-allowing supporting means slidably in a predetermined direction, wherein said pressing means includes a hydraulic mechanism for moving said rotation-allowing supporting means in said predetermined direction.

10. The terminal crimping apparatus according to claim 8, wherein each of said plurality of caulking means includes a conductor caulking member for caulking a portion of a crimp terminal about an end of a conductor of an electric wire and an insulated portion caulking member for caulking a portion of the crimp terminal about an insulated portion at the end of the electric wire, and said conductor caulking member and said insulated portion caulking member are held by said caulking means holding portion such that they are relatively movable in a radial direction of said rotating member.

11. The terminal crimping apparatus according to claim 10, further comprising relative position adjusting means for together adjusting the relative positions in said radial direction of said conductor caulking member and said insulated portion caulking member in each of the caulking means.

12. The terminal crimping apparatus according to claim 11, wherein said relative position adjusting means moves only one of said conductor caulking member and said insulated portion caulking member relative to said caulking means holding portion.

13. The terminal crimping apparatus according to claim 12, wherein said relative position adjusting means includes urging means for urging said one of said caulking members in a direction opposite to said radial direction, and moving means for pressing said one of said caulking members in the radial direction against said urging means to move said one caulking member.

14. The terminal crimping apparatus according to claim 13, wherein said moving means includes a shaft member which is movable in a direction along said predetermined axis around which said rotating member is rotatable, a cam surface formed on a peripheral surface of said shaft member for pressing each of said plurality of caulking members, and shaft member moving means for moving said shaft member in a direction along said predetermined axis.

15. The terminal crimping apparatus according to claim 14, wherein said cam surface includes a conical surface inclined with respect to the axis of said shaft member, and said shaft member moving means includes male screw means and female screw means which are fitted in each other, one of said male screw means and said female screw means being provided for said shaft member so that the rotation thereof is regulated, and the other being rotatable, wherein said shaft member moving means further includes rotational driving means for driving said the other of said male screw means and said female screw means to rotate.

16. The terminal crimping apparatus according to claim 1, wherein each of said plurality of caulking means includes a conductor caulking member for caulking a portion of a crimp terminal about an end of a conductor of an electric wire and an insulated portion caulking member for caulking a portion of the crimp terminal about an insulated portion in the end of the electric wire.

17. The terminal crimping apparatus according to claim 16, wherein said conductor caulking member and said insulated portion caulking member are held by said caulking means holding portion in a state where they are relatively movable in a direction in which said pressing means presses the caulking members, and further comprising relative position adjusting means for adjusting the relative positions, in the direction in which said pressing means presses the caulking members, of said conductor caulking member and said insulated portion caulking member.

18. The terminal crimping apparatus according to claim 17, wherein said relative position adjusting means moves only one of said conductor caulking member and said insulated portion caulking member relative to said caulking means holding portion.

19. The terminal crimping apparatus according to claim 18, wherein said relative position adjusting means includes urging means for urging said one of said caulking members in a direction opposite to the direction in which said pressing means presses the caulking members, and moving means for moving said one of said caulking members in the direction in which said pressing means presses said caulking members against said urging means.

20. The terminal crimping apparatus according to claim 1, wherein said pressing means includes a hydraulic mechanism for pressing said caulking means holding portion.

21. The terminal crimping apparatus according to claim 1, further comprising electric wire end feeding means for feeding an end of the electric wire to a predetermined position between the desired crimp terminal placed in said crimping position and the desired caulking means placed in said caulking waiting position.

22. The terminal crimping apparatus according to claim 21, wherein said electric wire end feeding means includes a plurality of holding means for respectively holding ends of a plurality of types of electric wires, and a rotating member rotatable around a predetermined axis, said plurality of holding means being mounted on said rotating member and arranged in a direction of rotation of said rotating member.

23. The terminal crimping apparatus according to claim 22, wherein said electric wire end feeding means further includes moving means for moving each of said plurality of holding means in a direction parallel to said predetermined axis.

* * * * *